US006441708B1

(12) United States Patent
Rodriguez et al.

(10) Patent No.: US 6,441,708 B1
(45) **Date of Patent: *Aug. 27, 2002**

(54) SHUNT TRIP DEVICE FOR A MOLDED CASE CIRCUIT BREAKER

(75) Inventors: Mauricio Rodriguez, Duluth; Jill Stegall, Atlanta; Bernard DiMarco, Lilburn, all of GA (US)

(73) Assignee: Siemens Energy & Automation, Inc., Alpharetta, GA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/434,567

(22) Filed: Nov. 5, 1999

(51) Int. Cl.[7] ..... H01H 9/00
(52) U.S. Cl. ..... 335/172; 335/14
(58) Field of Search ..... 335/14, 20, 23–25, 335/167–176

(56) References Cited

U.S. PATENT DOCUMENTS

| | | | | | |
|---|---|---|---|---|---|
| 4,097,831 | A | * | 6/1978 | Jencks et al. | 335/166 |
| 4,166,260 | A | | 8/1979 | Gillette | 335/20 |
| 4,297,663 | A | * | 10/1981 | Seymour et al. | 335/20 |
| 4,742,321 | A | * | 5/1988 | Nagy et al. | 335/20 |
| 4,887,055 | A | | 12/1989 | Male | 335/6 |
| 5,153,544 | A | | 10/1992 | Castonguay et al. | 335/167 |
| 5,331,301 | A | * | 7/1994 | Glennon et al. | 335/20 |
| 5,381,121 | A | * | 1/1995 | Peter et al. | 335/20 |
| 5,414,396 | A | | 5/1995 | Bagalini | 335/179 |
| 5,910,758 | A | | 6/1999 | Maloney et al. | 335/35 |

* cited by examiner

*Primary Examiner*—Lincoln Donovan
(74) *Attorney, Agent, or Firm*—Foley & Lardner

(57) ABSTRACT

The circuit breaker (10) including a molded housing (12) including a main breaker cover (20), a first terminal (18) and a second terminal (16) mounted in the casing with a contact (44) electrically coupled to the first terminal (18) and a movable contact (42) electrically coupled to the second terminal (16). It also includes an operating mechanism (40) having a pivoting member (13) movable between an ON position, an OFF position and a TRIPPED position, wherein the pivoting member (13) is coupled to the movable contact (42). An intermediate latching mechanism (52) is mounted in the housing (12) and coupled to the operating mechanism (40) is in selective operative contact with a trip unit having a trip bar (54). The trip unit is also coupled to the movable contact (42) and the second terminal (16). An accessory socket (22) formed in the main breaker cover (20), on either side of an opening for the pivoting member (13) is in communication with the housing (12). A latching protrusion (26) mounted in the socket (22) engages an accessory (80) installed in the accessory socket (22). An accessory cover (28) sized to cover the accessory (80) mounted in the accessory socket (22) is also provided. One such accessory (80) that can be installed in the socket (22) is a shunt trip device (200) which will trip the circuit breaker (12) upon receiving a power signal from a remote location.

17 Claims, 6 Drawing Sheets

SHUNT TRIP DEVICE FOR A MOLDED CASE CIRCUIT BREAKER

FIELD OF THE INVENTION

The present invention relates generally to the field of circuit breakers and more particularly to a molded case circuit breaker with a shunt trip device.

BACKGROUND OF THE INVENTION

In general the function of a circuit breaker is to electrically engage and disengage a selected circuit from an electrical power supply. This function occurs by engaging and disengaging a pair of operating contacts for each phase of the circuit breaker. The circuit breaker provides protection against persistent overcurrent conditions and against the very high currents produced by short circuits. Typically, one of each pair of the operating contacts are supported by a pivoting contact arm while the other operating contact is substantially stationary. The contact arm is pivoted by an operating mechanism such that the movable contact supported by the contact arm can be engaged and disengaged from the stationary contact.

There are two modes by which the operating mechanism for the circuit breaker can disengage the operating contacts: the circuit breaker operating handle can be used to activate the operating mechanism; or a tripping mechanism, responsive to unacceptable levels of current carried by the circuit breaker, can be used to activate the operating mechanism. For many circuit breakers, the operating handle is coupled to the operating mechanism such that when the tripping mechanism activates the operating mechanism to separate the contacts, the operating handle moves to a fault or tripped position.

To engage the operating contacts of the circuit breaker, the circuit breaker operating handle is used to activate the operating mechanism such that the movable contact(s) engage the stationary contact(s). A motor coupled to the circuit breaker operating handle can also be used to engage or disengage the operating contacts. The motor can be remotely operated.

A typical industrial circuit breaker will have a continuous current rating ranging from as low as 15 amps to as high as 160 amps. The tripping mechanism for the breaker usually consists of a thermal overload release and a magnetic short circuit release. The thermal overload release operates by means of a bimetallic element, in which current flowing through the conducting path of a circuit breaker generates heat in the bi-metal element, which causes the bi-metal to deflect and trip the breaker. The heat generated in the bi-metal is a function of the amount of current flowing through the bi-metal as well as for the period of time that that current is flowing. For a given range of current ratings, the bi-metal cross-section and related elements are specifically selected for such current range resulting in a number of different circuit breakers for each current range.

In the event of current levels above the normal operating level of the thermal overload release, it is desirable to trip the breaker without any intentional delay, as in the case of a short circuit in the protected circuit, therefore, an electromagnetic trip element is generally used. In a short circuit condition, the higher amount of current flowing through the circuit breaker activates a magnetic release which trips the breaker in a much faster time than occurs with the bi-metal heating. It is desirable to tune the magnetic trip elements so that the magnetic trip unit trips at lower short circuit currents at a lower continuous current rating and trips at a higher short circuit current at a higher continuous current rating. This matches the current tripping performance of the breaker with the typical equipment present downstream of the breaker on the load side of the circuit breaker.

In certain situations, an operator of an electrical system may desire to open a circuit breaker from a remote location. Such circumstances can include applications for maintenance and control. It may also be used in applications to provide synchronizing of several breakers, together with other accessories, to open and close several circuit breakers. One device used for tripping a circuit breaker from a remote location is a shunt trip accessory. The shunt trip accessory currently used have several disadvantages. Some such shunt trip accessories must be installed in the circuit breaker housing behind the main cover and in close proximity to electrically live parts and connections. Other shunt trip accessories require the user to provide terminal connections to the shunt trip wires. Further examples of present shunt trip accessories are designed to be used with a single circuit breaker frame, i.e., for each current rating of the circuit breaker a specially designed shunt trip accessory is required.

Thus, there is a need for a shunt trip accessory to open a circuit breaker from a remote location that can be installed in the main cover of the circuit breaker without exposing the electrically live arts of the circuit breaker. There is a further need for a shunt trip device that can be used with several circuit breaker frame sizes, that is a single shunt trip device that will operate over a wide range of current ratings for the circuit breaker. There is an additional need for a shunt trip device with which a customer can connect its control wiring directly to the shunt trip device without any additional rewiring. And further, there is a need for a shunt trip device for a circuit breaker that can be installed in a circuit breaker utilizing a common latching protrusion that provides an audible snap fit installation.

SUMMARY OF THE INVENTION

The present invention provides a shunt trip device for a molded case circuit breaker with the circuit breaking having an operating mechanism, a trip bar and a cover. The shunt trip device comprises a base and a top mount with a solenoid having a plunger mounted on the base. The shunt trip bar actuator is attached to a push plate member mounted on the base and aligned with the plunger of the solenoid. The shunt trip bar actuator is aligned and in selective contact with the trip bar of the circuit breaker. A spring installed between the solenoid and the push plate member biases the push plate and trip bar actuator assembly towards a reset position. A clearing switch is mounted on the base and connected in series with the solenoid. The clearing switch is coupled to a cross bar switch actuator which is in contact with the operating mechanism of the circuit breaker. Upon receiving a control power signal from a remote location, the solenoid is energized and the plunger forces the shunt trip device against the trip bar of the circuit breaker thereby unlatching the operating mechanism of the circuit breaker and opening the contacts in the circuit breaker housing. When the circuit breaker operating mechanism opens, the cross bar in the operating mechanism moves the cross bar switch actuator in the clearing switch thereby opening the clearing switch and cutting off power to the solenoid. The spring then forces the push plate member back into its reset position. The clearing switch cannot be reset until the circuit breaker is closed and the cross bar of the circuit breaker moves the cross bar switch actuator back to its reset position.

The circuit breaker of the present invention includes a molded housing including a main breaker cover, a first terminal and a second terminal mounted in the casing with a contact electrically coupled to the first terminal and a movable contact electrically coupled to the second terminal. It also included an operating mechanism having a pivoting member movable between an ON position, an OFF position and a TRIPPED position, wherein the pivoting member is coupled to the movable contact. An intermediate latching mechanism mounted in the housing and coupled to the operating mechanism is in selective operative contact with a trip unit having a trip bar. The trip unit is also coupled to the movable contact and the second terminal. An accessory socket formed in the main breaker cover, on either side of an opening for the pivoting member is in communication with the housing. A latching protrusion mounted in the socket engages an accessory installed in the accessory socket. An accessory cover sized to cover the accessory mounted in the accessory socket is also provided. One such accessory that can be installed in the socket is a shunt trip device which will trip the circuit breaker upon receiving a power signal from a remote location.

The present invention also includes a method for tripping a molded case circuit breaker having an operating mechanism configured to open and close a power circuit, a trip unit with an intermediate latch and a breaker cover with the tripping of the circuit breaker occurring from a remote location. The method for tripping comprising the steps of closing the circuit breaker with the operating mechanism, installing a shunt trip device in the circuit breaker cover, providing power to the solenoid through a clearing switch from a remote location whereby the solenoid forces the trip unit to unlatch the operating mechanism to open the power circuit and then moving the clearing switch to an open position with the operating mechanism whereby power to the solenoid is cut off.

DETAILED DESCRIPTION OF THE PREFERRED EMBODIMENTS

Figure 1:
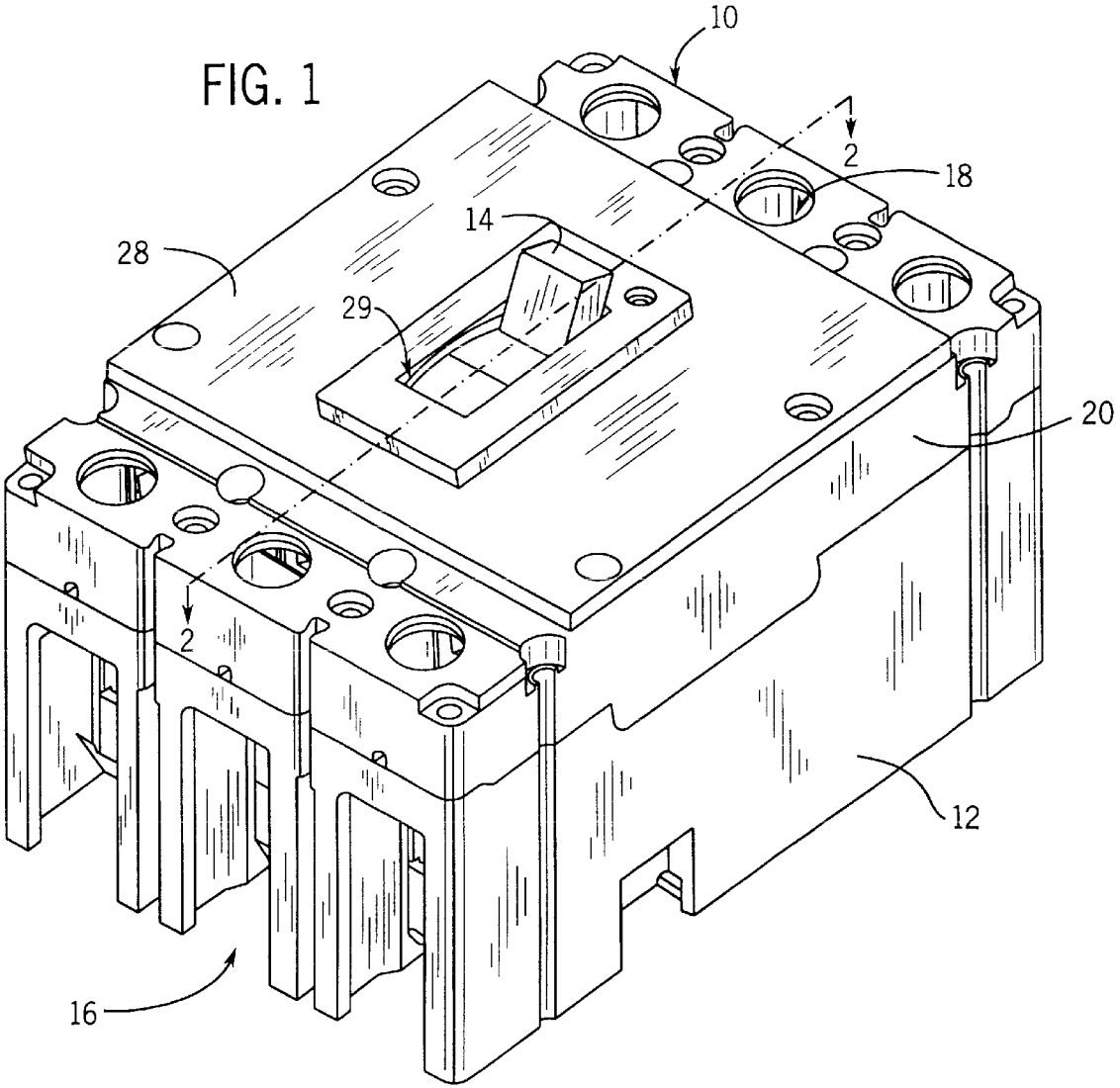
FIG. 1 is an isometric drawing of a molded case circuit breaker which includes an embodiment of the present shunt trip device unit capable of broad rating applications.

FIG. 1 generally illustrates a three phase molded case circuit breaker 10 of the type which includes an operating mechanism 40 having a pivoting member 13 with a handle 14. The pivoting member 13 and handle 14 are moveable between an ON position, an OFF position and a TRIPPED position. The exemplary circuit breaker 10 is a three pole breaker having three sets of contacts for interrupting current in each of the three respective electrical transmission phases. In the exemplary embodiment of the invention, each phase includes separate breaker contacts and a separate trip mechanism. The center pole circuit breaker includes an operating mechanism which controls the switching of all three poles of the breaker. Although an embodiment of the present invention is described in the context of the three phase circuit breaker, it is contemplated that it may be practiced in a single phase circuit breaker or in other multi-phase circuit breakers.

Figure 2:
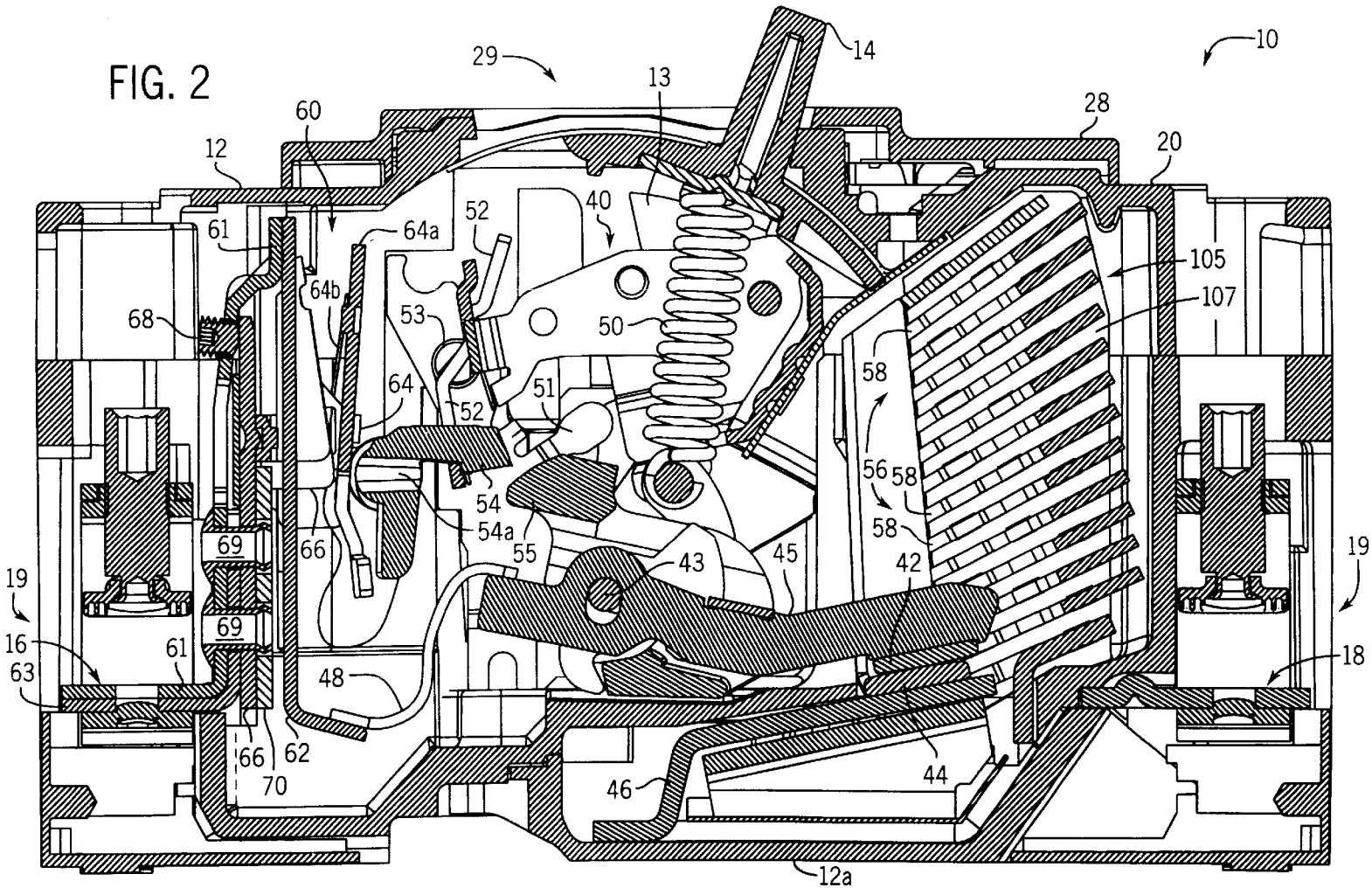
FIG. 2 is a section view of the circuit breaker shown in FIG. 1 along the lines 2—2 and is used to describe the operation of the circuit breaker.

Referring to FIG. 2., handle 14 is operable between the ON and OFF positions to enable a contact operating mechanism 40 to engage and disengage a moveable contact 42 and a stationary contact 44 for each of the three phases, such that the line terminal 18 and load terminal 16 of each phase can be electrically connected. The circuit breaker housing 12 includes three portions which are molded from an insulating material. These portions include a circuit breaker base 12, a circuit breaker cover 20 and an accessory cover 28 with breaker cover 20 and the accessory cover 28 having an opening 29 for the handle 14 of the pivoting member 13. The pivoting member 13 and handle 14 move within the opening 29 during the several operations of the circuit breaker 10. FIG. 2 is a cut away view of the circuit breaker 10 along the lines 2—2 shown in FIG. 1. As shown in FIG. 2, the main components of the circuit breaker are a fixed line contact arm 46 and a moveable load contact arm 45. It should be noted that another embodiment of the circuit breaker 10 has a movable line contact arm to facilitate a faster current interruption action. The load contact arms for each of the three phases of the exemplary breaker are mechanically connected together by an insulating cross bar member 55. This cross bar member 55, in turn, is mechanically coupled to the operating mechanism 40 so that, by moving the handle 14 from left to right, the cross bar 55 rotates in a clockwise direction and all three load contact arms 45 are concurrently moved to engage their corresponding line contact arms 46, thereby making electrical contact between moveable contact pad 42 and stationary contact pad 44.

The operating mechanism 40 includes a cradle 41 which engages an intermediate latch 52 to hold the contacts of the circuit breaker in a closed position unless and until an over current condition occurs, which causes the circuit breaker to trip. A portion of the moveable contact arm 45 and the stationary contact bus 46 are contained in an arc chamber 56. Each pole of the circuit breaker 10 is provided with an arc chamber 56 which is molded from an insulating material and is part of the circuit breaker 10 housing 12. A plurality of arc plates 58 are maintained in the arc chamber 56. The arc plates facilitate the extension and cooling of the arc formed when the circuit breaker 10 is opened while under a load and drawing current. The arc chamber 56 and arc plates 58 direct the arc away from the operating mechanism 40.

The exemplary intermediate latch 52 is generally Z-shaped having an upper leg which includes a latch surface that engages the cradle 41 and a lower leg having a latch surface which engages a trip bar 54. The center portion of the Z-shaped intermediate latch element 52 is angled with respect to the upper and lower legs and includes two tabs which provide a pivot edge for the intermediate latch 52 when it is inserted into the mechanical frame 51. As shown in FIG. 2, the intermediate latch 52 is coupled to a torsion spring 53 which is retained in the mechanical frame 51 by the mounting tabs of the intermediate latch 52. The torsion spring 53 biases the upper latch surface of the intermediate latch 52 toward the cradle 41 while at the same time biasing the trip bar 54 into a position which engages the lower latch surface of the intermediate latch 52. The trip bar 54 pivots in a counter clockwise direction about an axis 54*a*, responsive to a force exerted by a bimetallic element 62, during, for example, a long duration over current condition. As the trip bar 54 rotates, in a counter clockwise direction, the latch surface on the upper portion of the trip bar disengages the latch surface on the lower portion of the intermediate latch 52. When this latch surface of the intermediate latch 52 is disengaged, the intermediate latch 52 rotates in a counter clockwise direction under the force of the operating mechanism 40, exerted through a cradle 41. In the exemplary circuit breaker, this force is provided by a tension spring 50. Tension is applied to the spring when the breaker toggle handle 14 is moved from the open position to the closed position. More than one tension spring 50 may be utilized.

As the intermediate latch 52 rotates responsive to the upward force exerted by the cradle 41, it releases the latch on the operating mechanism 40, allowing the cradle 41 to rotate in a clockwise direction. When the cradle 41 rotates, the operating mechanism 40 is released and the cross bar 55 rotates in a counter clockwise direction to move the load contact arms 45 away from the line contact arms 46.

During normal operation of the circuit breaker, current flows from the line terminal 18 through the line contact arm 46 and its stationary contact pad 44 to the load contact arm 45 through its contact pad 42. From the load contact arm 45, the current flows through a flexible braid 48 to the bimetallic element 62 and from the bimetallic element 62 to the load terminal 16. (See FIG. 3) When the current flowing through the circuit breaker exceeds the rated current for the breaker, it heats the bimetallic element 62, causing the element 62 to bend towards the trip bar 54. If the over current condition persists, the bimetallic element 62 bends sufficiently to engage the trip bar surface. As the bimetallic element engages the trip bar surface and continues to bend, it causes the trip bar 54 to rotate in a counter clockwise direction releasing the intermediate latch 52 and thus unlatching the operating mechanism 40 of the circuit breaker.

Figure 3:
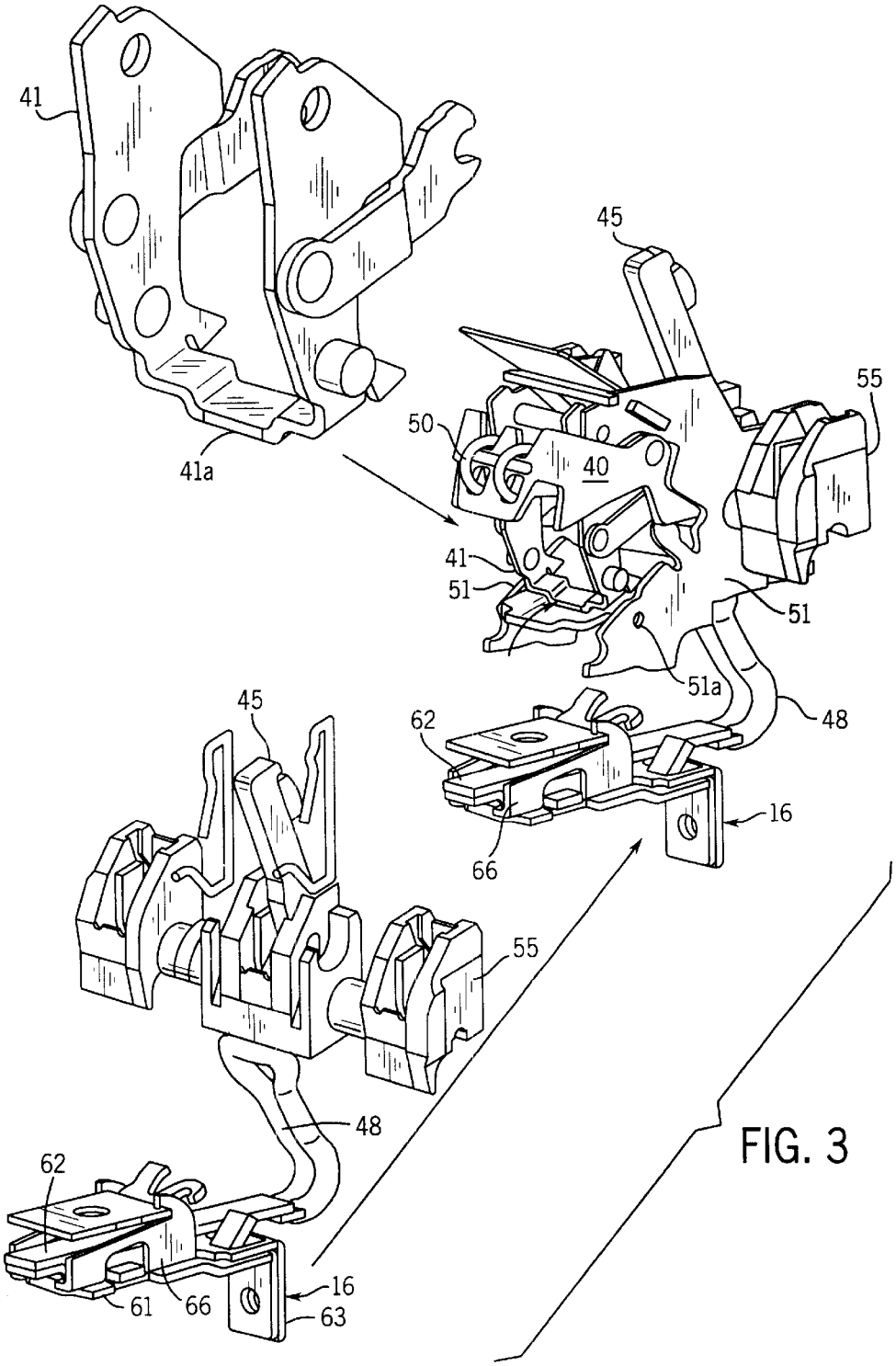
FIG. 3 is an exploded isometric drawing of the operating mechanism, contact structure and bi-metal trip unit of the circuit breaker shown in FIG. 1.

FIG. 3 is an exploded isometric drawing which illustrates the construction of a portion of the circuit breaker shown in FIG. 2. In FIG. 3 only the load contact arm 45 of the center pole of the circuit breaker is shown. This load contact arm 45 as well as the contact arms for the other two poles, are fixed in position in the cross bar element 55. As mentioned above, additional poles, such as a four pole molded case circuit breaker can utilize the same construction as described herein, with the fourth pole allocated to a neutral. The load contact arm 45 is coupled to the bimetallic element 62 by a flexible conductor 48 (e.g. braided copper strand). As shown in FIG. 3, current flows from the flexible conductor 48 through the bimetallic element 62 to a connection at the top of the bimetallic element 62 which couples the current to the load terminal 16 through the load bus 61. The load bus 61 is supported by a load bus support 63. It should be noted that more than one flexible conductor 48 may be utilized.

In the exemplary circuit breaker 10, the cross bar 55 is coupled to the operating mechanism 40, which is held in place in the base or housing 12 of the molded case circuit breaker 10 by a mechanical frame 51. The key element of the operating mechanism 40 is the cradle 41. As shown in FIG. 3, the cradle 41 includes a latch surface 41*a* which engages the upper latch surface in the intermediate latch 52. The intermediate latch 52 is held in place by its mounting tabs which extend through the respective openings 51*a* on either side of the mechanical frame 51. In the exemplary embodiment of the circuit breaker, the two side members of the mechanical frame 51 support the operating mechanism 40 of the circuit breaker 10 and retain the operating mechanism 40 in the base 12 of the circuit breaker 10.

Figure 4:
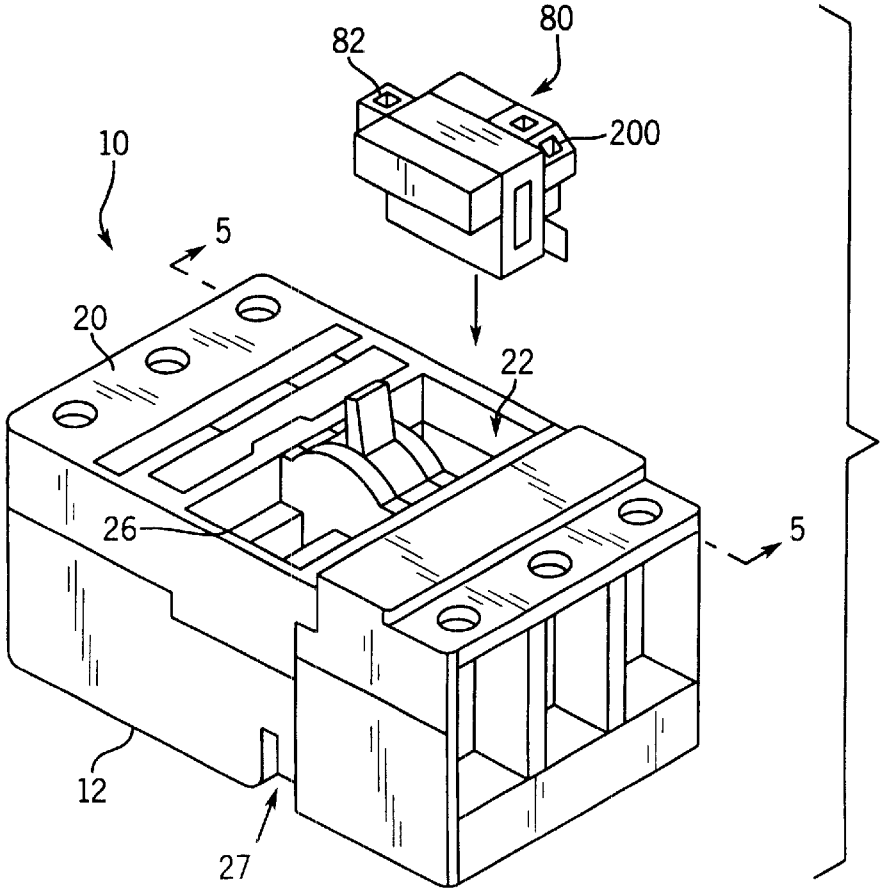
FIG. 4 is an illustration of the circuit breaker cover for the circuit breaker shown in FIG. 1.

FIG. 4 illustrates the breaker cover 20. The breaker cover 20, in the preferred embodiment, has two accessory sockets 22 formed in the cover 20, with one accessory socket 22 on either side of the opening 29 for the pivoting member 13 and handle 14. The breaker cover 20 with the accessory sockets 22 or compartments can be formed, usually by well known molding techniques, as an integral unit. The accessory socket 22 can also be fabricated separately and attached to the breaker cover 20 by any suitable method such as with fasteners or adhesives. The breaker cover 20 is sized to cover the operating mechanism 40, the moveable contact 42 and the stationary contact 44, as well as the trip mechanism 60 of the circuit breaker 10. The breaker cover has an opening 29 to accommodate the handle 14.

Each accessory socket or compartment 22 is provided with a plurality of openings 24. The accessory socket openings 24 are positioned in the socket 22 to facilitate coupling of an accessory 80 with the operating mechanism 40 mounted in the housing 12. The accessory socket openings 24 also facilitate simultaneous coupling of an accessory 80 with different parts of the operating mechanism 40. Various accessories 80 can be mounted in the accessory compartment 22 to perform various functions. Some accessories, such as a shunt trip, will trip the circuit breaker 10, upon receiving a remote signal, by pushing the trip bar 54, causing release of the mechanism latch 52 of the operating mechanism 40.

The shunt trip has a member protruding through one of the openings in the accessory socket 22 and engages the operating mechanism 40, via the trip bar 54. Another accessory, such as an auxiliary switch, provides a signal indicating the status of the circuit breaker 10, e.g. "on" or "off". When the auxiliary switch is nested in the accessory socket 22, a member on the switch assembly protrudes through one of the openings 24 in the socket 22 and is in engagement with the operating mechanism 40, typically the cross bar 55. Multiple switches can be nested in one accessory socket 22 and each switch can engage the operating mechanism through a different opening 24 in the socket 22.

An accessory 80 that can be inserted in the accessory socket 22 of the cover 20 of the circuit breaker 10 is a shunt trip device accessory 200 as shown in FIGS. 6, 7, 8 and 9. The shunt trip device 200 is installed in the cover as illustrated in FIG. 4 and nests in the accessory socket 22 of the cover 20 as shown as one embodiment in FIG. 5.

Figure 6:
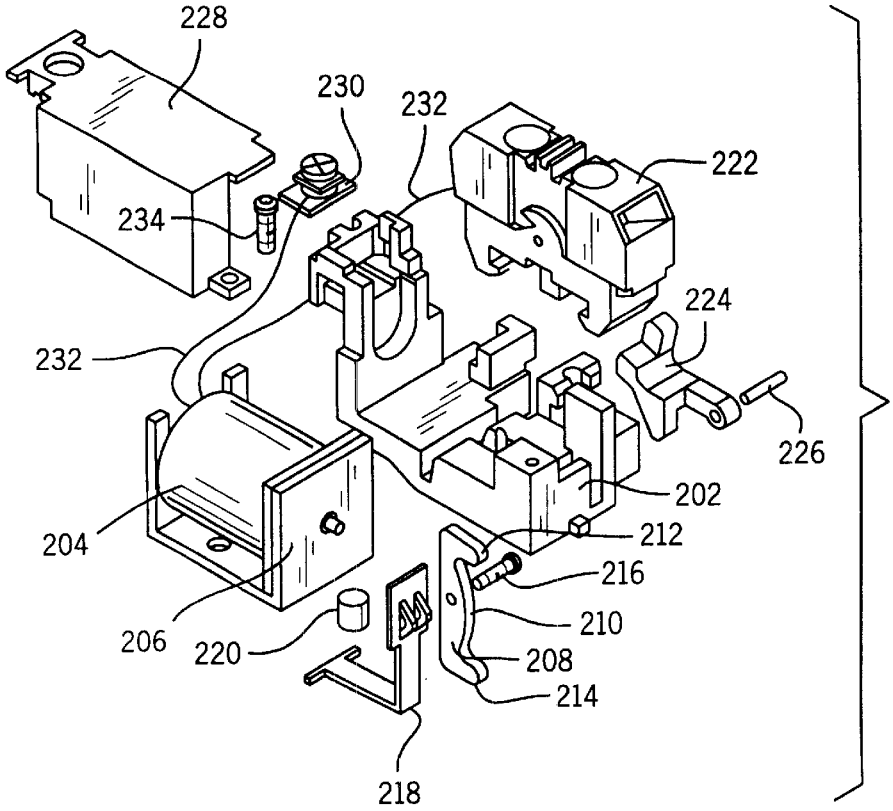
FIG. 6 is an exploded, perspective view of an embodiment of the present shunt trip device.

Referring now to FIG. 6, there is illustrated an embodiment of a shunt trip device 200. A base 202 supports the various elements of the shunt trip device 200 and is provided with a number of detents, slots and mounting orifices for the various elements of the shunt trip device 200. A solenoid 204 having a solenoid plunger 206 is mounted on the base 202. The solenoid 204 is partially covered by a top mount 228 which is secured to the base 202 by a fastener 234. An accessory detent 82 is provided. The accessory detent 82 engages a latching protrusion 26 mounted in the accessory socket 22 to retain the accessory 80 in the accessory socket 22. In the present shunt trip accessory 200 the accessory detent 82 is formed on the base 202. In another embodiment of the shunt trip accessory device 200, as illustrated in FIG.

Figure 5:
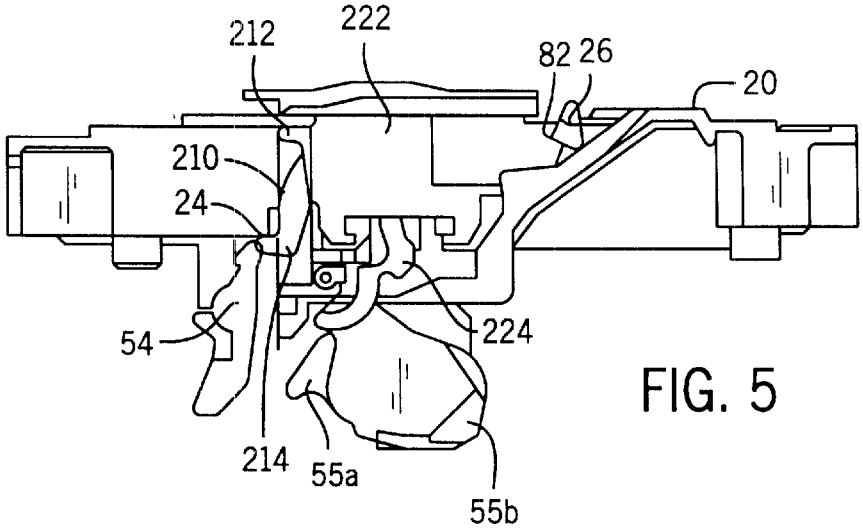
FIG. 5 is a sectional view of the circuit breaker shown in FIG. 4 along line 5—5 and illustrating an embodiment of the present shunt device installed in the cover and engaged with the cross bar of the circuit breaker in two positions.

9 and described below, the accessory detent 82 is formed on a resilient member. The base 202 and top mount 228 can be formed or fabricated from any suitable material, with the preferred embodiment being a molded plastic. A shunt trip bar actuator 208 is attached to a push plate member 218 by a mounting pin 216 and installed in one of the slots in the base 202. A return spring 220 is inserted between the push plate member 218 and the solenoid 204 with the return spring 220 biasing the push plate member 218 to a reset position as will be explained in more detail below. The shunt trip bar actuator 208 is formed or fabricated to have a middle portion 210, a high probe 212 and a low probe 214. The high probe or the low probe selectively contacts the trip bar 54 of the trip mechanism unit 60 of the circuit breaker 10 which in turn engages the intermediate latch 52 of the circuit breaker 10. In operation, the solenoid 204 receives an electrical power control signal from a remote location which energizes the solenoid 204. The solenoid plunger 206 extends and pushes against the push plate member 218 which causes the attached shunt trip bar actuator 208 to move against a wall of the accessory socket 22 in the circuit breaker cover 20. The middle portion 210 of the shunt trip bar actuator 208 acts as a fulcrum about which the shunt trip bar actuator 208 rotates either the high probe 212 or the low probe 214 into a socket opening 24 in the accessory socket 22. The high probe 212 or low probe 214 selectively contacts the trip bar 54 of the circuit breaker thereby engaging the intermediate latch 52 which unlatches the operating mechanism 40 of the circuit breaker 10 which opens the contacts 42, 44 to disrupt the power circuit in which the circuit breaker 10 is installed. The high probe 212 and low probe 214 will enter the socket opening 24 that is available in the accessory socket 22 in the cover 20. It is contemplated that the circuit breaker frames rated for a continuous current of 125 amps. will have the socket opening 24 located in the lower portion of the accessory socket 22, while a circuit breaker rated for a continuous current of 160 amps. through 400 amps. would have the socket opening 24 located in an upper portion of the accessory socket 22 wall of the cover 20. FIG. 5 illustrates the circuit breaker cover 20 for a breaker rated at 125 amps. with the socket opening 24 in the lower portion of the accessory socket 22 and the low probe 214 engaging the trip bar 54 with the middle portion 210 of the shunt trip bar actuator 208 forming the fulcrum against the wall of the accessory socket 22.

Figure 7:
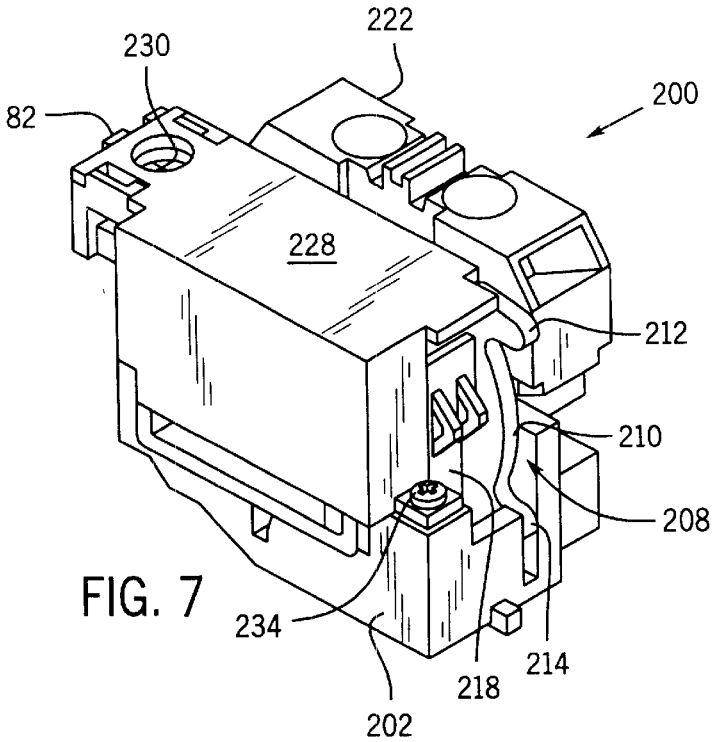
FIG. 7 is a perspective view of an embodiment of an assembled shunt trip device.
Figure 8:
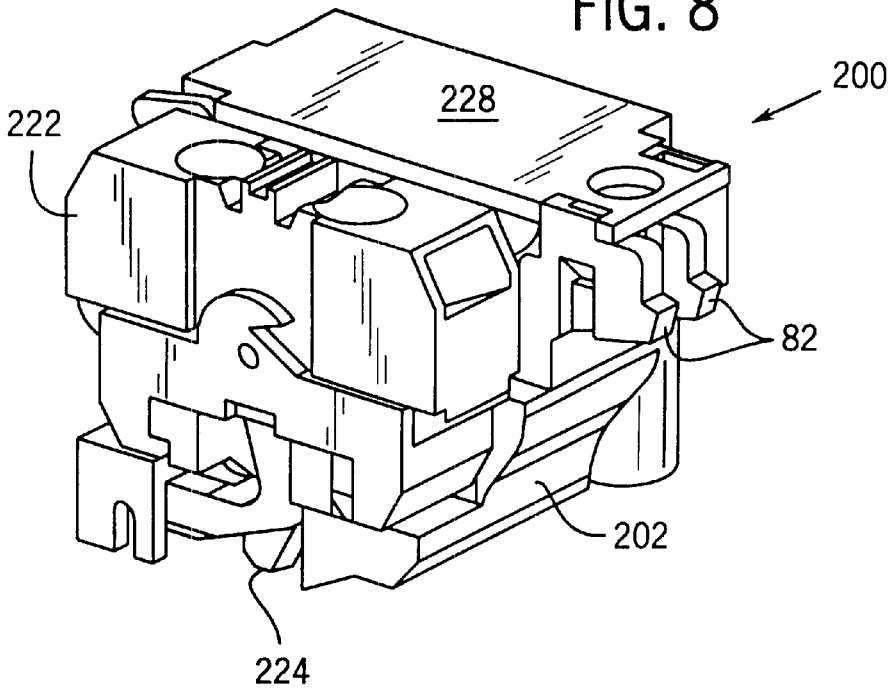
FIG. 8 is a perspective view of the shunt trip device illustrated in FIG. 7 turned 180°.

Also mounted on the base 202 of the present shunt trip accessory device 200 is a clearing switch 222. The clearing switch 222 can be mounted with fasteners or the engagement of detents formed in the base 202 or the switch. FIGS. 7 and 8 show an assembled shunt trip accessory device 200 with the clearing switch 222 engaging the base 202 with a dove tail arrangement. FIGS. 7 and 8 also illustrate the top mount 228 mounted on the base 202 and enclosing the solenoid 204. The clearing switch 222 is electrically wired in series with the solenoid 204 by wires 232 connected between the clearing switch 222 and the solenoid 204 and the solenoid 204 and a terminal 230 which is mounted in a convenient location in the top mount 228. It should be understood that the terminal 230 can be mounted in any convenient location and can be of any suitable construction that is compatible with the environment and electrical rating of the solenoid 204. The clearing switch 222 is a normally closed switch and is actuated by a cross bar switch actuator 224 which is pivotally mounted to the base 202 by a pivot pin 226 and is operatively coupled to the clearing switch 222. When the shunt trip accessory device 200 is installed in the accessory socket 22, the cross bar switch actuator 224 extends through a socket opening 24 in the lower portion of the accessory socket 22 of the cover 20. The cross bar switch actuator 224 contacts the cross bar 55 of the operating mechanism 40 of the circuit breaker 10. FIG. 5 illustrates the cross bar switch actuator 224 extending through a socket opening 24 and in contact with the cross bar 55 of the operating mechanism 40, in an open position **55*b* and a closed position 55*a*. As the circuit breaker contacts 42,44 are opened and closed the cross bar 55 of the operating mechanism 40 moves between an opened 55*b* and a closed 55*a* position and vice versa. The movement of the cross bar 55 also moves the cross bar switch actuator 224 which opens or closes the clearing switch 222**.

In operation, with the circuit breaker 10 closed (in the ON position) the clearing switch 222 would be normally closed. A pair of control wires are passed through a wire channel 27 in the circuit breaker 10 and connected to the clearing switch 222 and the terminal 230. If an operator desires to intentionally trip the circuit breaker, i.e., open the contacts of the circuit breaker 10, a power control signal is applied to the wires through the clearing switch 222 to energize the solenoid 204. As described above, the solenoid plunger 206 forces the push plate member 218 and the attached shunt trip bar actuator 208 to contact the trip bar 54 and trip the circuit breaker operating mechanism 40. When the contacts of the circuit breaker 10 open the cross bar 55 of the operating system 40 (which is coupled to the movable contact arm 45 of the circuit breaker, moves from the closed position **55*a* to the open position 55*b* which moves the cross bar switch actuator 224 and opens the clearing switch 222 thereby cutting off the power to the solenoid 204 and de-energizing it. With the solenoid 204 de-energized, the solenoid plunger 204 moves back to its reset position by action of the push plate member 208 being motivated by the return spring 220 mounted between the push plate member 218 and the solenoid 204. The solenoid 204 cannot be energized again until the clearing switch 222 is again closed. The action of an operator resetting and closing the circuit breaker 10 by use of the handle 14 will move the cross bar 55 of the operating system 40 from the open position 55*b* to the closed position 55*a* which in turn moves the cross bar switch actuator 224 and closes the clearing switch 222 with the shunt trip accessory device 200** then being in a reset or operative condition.

Figure 9:
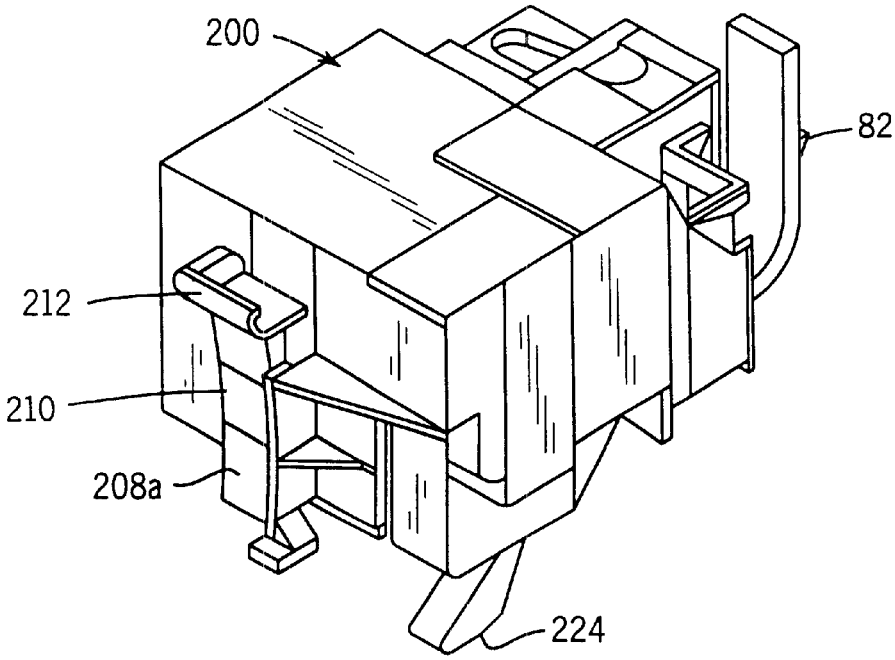
FIG. 9 is another embodiment of the present shunt trip device illustrating the integral shunt trip bar actuator and push plate member.

Another embodiment of the present shunt trip accessory device 200 is illustrated in FIG. 9. This embodiment typically is installed in a circuit breaker 10 having a current rating in excess of 400 amps. However, it still functions in substantially the same manner as the previously described embodiments with the exception that the shunt trip bar actuator 208 and the push plate member 218 are integrally formed as a single piece **208*a*. The integral shunt trip bar actuator 208*a* is pushed by the solenoid plunger 206 of the solenoid 204 to trip the circuit breaker 10** as described above.

While the embodiments illustrated in the figures and described above are presently preferred, it should be understood that these embodiments are offered by way of example only. Invention is not intended to be limited to any particular embodiment, but it is intended to extend to various modifications that nevertheless fall within the scope of the intended claims. For example, the top mount can be configured to enclose the clearing switch as well as the solenoid. It is also contemplated that the solenoid can receive its control power signal from an electronic control circuit connected to the circuit breaker. Additionally, it is also contemplated that the trip mechanism having a bi-metal trip unit or an electronic trip unit with a load terminal be housed in a separate housing capable of mechanically and electrically connecting to another housing containing the operating mechanism and line terminal thereby providing for a quick and easy change of current ratings for an application of the circuit breaker contemplated herein. Other modifications will be evident to those with ordinary skill in the art.

What is claimed is:

1. A shunt trip device for a molded case circuit breaker having an operating mechanism, a trip bar and a cover, the shunt trip device comprising:

a base and a top mount;

a solenoid having a plunger, mounted on the base;

a shunt trip bar actuator, having a high probe, a middle portion, and a low probe, with the shunt trip bar actuator attached at the middle portion with a mounting pin to a push plate member mounted on the base and aligned with the plunger, wherein the middle portion of the shunt trip bar actuator provides a fulcrum for pivoting one of the high probe and low probe toward and into an opening in a socket in the cover of the circuit breaker to selectively contact the trip bar;

a spring installed between the solenoid and the push plate member; and, a clearing switch mounted on the base and connected in series with the solenoid, with the clearing switch having a crossbar switch actuator in contact with the operating mechanism.

2. The shunt trip device of claim 1, wherein the low probe contacts the cover and the high probe of the shunt trip bar actuator engages the trip bar through the opening in the cover.

3. The shunt trip device of claim 1, wherein the high probe contacts the cover and the low probe of the shunt trip bar actuator engages the trip bar through the opening in the cover.

4. The shunt trip device of claim 1, wherein the shunt trip actuator and the push plate member are integrated as one piece.

5. The shunt trip device of claim 1, including an accessory detent on the top mount and aligned to engage a latching protrusion on the cover.

6. A molded case circuit breaker comprising:

a molded housing including a main breaker cover;

a first terminal and a second terminal mounted in the case;

a contact electrically coupled to the first terminal;

a moveable contact electrically coupled to the second terminal;

an operating mechanism having a pivoting member moveable between an ON position, an OFF position and a TRIPPED position, wherein the pivoting member is coupled to the moveable contact;

an intermediate latching mechanism mounted in the housing and coupled to the operating mechanism; and a trip unit having a trip bar and coupled to the moveable contact and the second terminal with the trip unit in selective operative contact with the intermediate latching mechanism; and, an accessory socket formed in the main breaker cover on either side of an opening for the pivoting member, with the accessory socket in communication with the housing;

a latching protrusion in the socket for engaging an accessory;

an accessory cover sized to cover the accessory mounted in the accessory socket; and, a shunt trip device installed in the socket, the shunt trip device comprising:

a base and a top mount;

a solenoid to remotely trip the breaker, having a plunger mounted on the base;

a shunt trip bar actuator, having a high probe, a middle portion, and a low probe, with the shunt trip bar actuator attached at the middle portion with a mounting pin to a push plate member mounted on the base and aligned with the plunger, wherein the middle portion of the shunt trip bar actuator provides a fulcrum for pivoting one of the high probe and low probe toward and into an opening in a socket in the cover of the circuit breaker to selectively contact the trip bar;

a spring installed between the solenoid and the push plate member; and, a clearing switch mounted on the base and connected in series with the solenoid, with the clearing switch having a crossbar switch actuator in contact with the operating mechanism.

7. The shunt trip device of claim 6, wherein the high probe contacts the cover and the low probe of the shunt trip bar actuator engages the trip bar through the opening in the cover.

8. The shunt trip device of claim 7, wherein the low probe contacts the cover and the high probe of the shunt trip bar actuator engages the trip bar through the opening in the cover.

9. The shunt trip device of claim 6, wherein the shunt trip actuator and the push plate member are integrated as one piece.

10. The shunt trip device of claim 6, including an accessory detent on the top mount and aligned to engage a latching protrusion on the cover.

11. A method for tripping a molded case circuit breaker having an operating mechanism configured to open and close a power circuit, a trip unit with an intermediate latch and a main breaker cover, from a remote location, the method for tripping comprising the steps of:

closing the circuit breaker with the operating mechanism;

installing a shunt trip device in the breaker cover, the shunt device having a solenoid and a clearing switch wired in series with the solenoid in operative contact with the trip unit, with the shunt trip device including a shunt trip bar actuator having a high probe, a middle portion and a low probe, wherein the middle portion of the shunt trip bar actuator provides a fulcrum for pivoting one of the high probe and low probe toward and into an opening in the cover and contacting the trip unit, and the clearing switch in operative contact with the operating mechanism;

providing power to the solenoid through the clearing switch from a remote location, whereby the solenoid forces the trip unit to unlatch the operating mechanism to open the power circuit; and moving the clearing switch to an open position with the operating mechanism, whereby power to the solenoid is cut off.

12. The method of claim 11, further comprising:

determining whether the power circuit is open or closed and closing the clearing switch only if the power circuit is closed.

13. The method of claim 11, further comprising retaining the shunt trip device to the circuit breaker main cover such that an audible snap is generated.

14. A circuit breaker comprising:

a molded housing including a base and a cover;

a means for connecting a load to the circuit breaker, mounted in the housing;

a means for connecting an electrical line to the circuit breaker;

a means for coupling electrically to the means for connecting an electrical line;

a movable means for contacting the means for connecting an electrical line to a means for operating mounted in the housing coupled with the means for operating having a pivoting member movable between an ON position, an OFF position, and a TRIPPED position, with the pivoting member coupled to the movable means for contacting and with the means for operating coupled to an intermediate means for latching the means for operating;

a means for tripping coupled to the movable means for contacting and the means for connecting a load with the intermediate means for latching, wherein the means for tripping includes a means for releasing under a short circuit condition and a means for releasing under an overload condition; and a means for remotely tripping the circuit breaker mounted in a compartment in the cover and operatively connected to the means for tripping.

15. The circuit breaker of claim 14 wherein the compartment includes a means for retaining the means for remotely tripping.

16. The circuit breaker of claim 14, including a means for preventing the operation of the means for remotely tripping if the circuit breaker is not closed.

17. The circuit breaker of claim 16, wherein the means for remotely tripping will operate upon receiving a power signal from a location remote from the circuit breaker, whereby the means for remotely tripping will engage the means for tripping in the housing.

* * * * *